US005172575A

United States Patent [19]

Fisher

[11] Patent Number: 5,172,575

[45] Date of Patent: Dec. 22, 1992

[54] GUN BOX LATCHING MECHANISM

[76] Inventor: Thomas I. Fisher, R.D. #2, Rte. 100, Pottstown, Pa. 19464

[21] Appl. No.: 757,696

[22] Filed: Sep. 11, 1991

[51] Int. Cl.[5] ..... E05B 65/52

[52] U.S. Cl. ..... 70/63; 70/71; 70/289; 206/317; 292/150

[58] Field of Search ..... 70/63, 71, 289; 292/150, DIG. 41, DIG. 65; 206/317; 224/912, 913

[56] References Cited

U.S. PATENT DOCUMENTS

| | | | |
|---|---|---|---|
| 380,738 | 4/1888 | Bachman | 292/163 |
| 467,816 | 1/1892 | Kimball . | |
| 545,277 | 8/1895 | Feinberg . | |
| 1,617,813 | 2/1927 | Judge | 292/163 X |
| 2,171,663 | 9/1939 | Marchand . | |
| 2,233,699 | 3/1941 | Gorrell . | |
| 2,706,036 | 4/1955 | Neal | 206/317 |
| 2,936,189 | 5/1960 | Pearson . | |
| 3,151,698 | 10/1964 | Pollock | 292/DIG. 65 X |
| 3,307,755 | 3/1967 | Lentz . | |
| 3,432,198 | 3/1969 | Connor | 292/DIG. 41 X |
| 3,514,981 | 6/1970 | Esquibel et al. | 70/63 X |
| 3,519,299 | 7/1970 | Godwin . | |
| 3,637,245 | 1/1972 | Levack | 292/45 |
| 3,666,338 | 5/1972 | Russell . | |
| 3,744,830 | 7/1973 | Levack | 292/29 |
| 3,893,721 | 7/1975 | Upton | 292/30 |
| 3,907,103 | 9/1975 | Shaw | 206/1.5 |
| 4,119,199 | 10/1978 | Whitaker, Jr. | 206/317 |
| 4,286,809 | 9/1981 | Godwin | 292/54 |
| 4,721,205 | 1/1988 | Burt et al. | 206/317 |
| 4,746,008 | 5/1988 | Heverly et al. | 206/1.5 |
| 4,768,021 | 8/1988 | Ferraro | 340/568 |
| 4,854,448 | 8/1989 | Hair, II | 206/1.5 |
| 4,902,054 | 2/1990 | Swanson | 292/254 |
| 5,009,088 | 4/1991 | Cislo | 70/63 |

*Primary Examiner*—Lloyd A. Gall
*Attorney, Agent, or Firm*—Ratner & Prestia

[57] ABSTRACT

A portable gun box for safely storing at least one of a variety of loaded and unloaded firearms. The gun box includes a child-resistant latching mechanism positioned inside the gun box. In turn, the latching mechanism has a slideable first latching arm; a slidable second latching arm adapted to engage and disengage the first latching arm; a catch attached to the second latching arm to engage a hook on the lid of the gun box when the gun box is closed and to disengage that hook when the gun box is open; and a guide bracket attached to the gun box and substantially surrounding the catch to prevent the hook from disengaging the catch unless the first latching arm and the second latching arm are disengaged. The gun box also includes structure positioned outside the gun box, and penetrating to inside the gun box to engage the latching mechanism and allow the latching mechanism to be operated from outside the gun box, and resilient linings for pushing open the lid of the gun box when the latching mechanism is released.

19 Claims, 5 Drawing Sheets

GUN BOX LATCHING MECHANISM

FIELD OF THE INVENTION

This invention relates to a latching mechanism for a gun box and, more particularly, to a latching mechanism which provides quick and easy opening, even in the dark, of a gun box while providing a child-resistant safety feature.

BACKGROUND OF THE INVENTION

Many people have firearms for recreational use such as target shooting. Others collect firearms. Moreover, an ever-increasing number of people are keeping guns, such as automatic pistols and revolvers, in their homes and offices for protection. No matter what the purpose for the gun, the gun owner must have a safe storage box to protect the gun against unauthorized access and accidental discharge or misuse.

The presence of a gun in the home or office is a perpetual concern for the owner. Newspaper accounts and word of mouth have recounted the numerous accidents and tragedies associated with the accidental discharge of firearms each year. A large number of serious injuries and fatalities occur to young children. The gun owner also fears arriving at home or work to find an intruder waiting with the owner's own gun. Thus, unauthorized access even by adults is a concern.

In contrast to the owner's need for a gun box latching mechanism which prevents unauthorized and accidental opening is the need for immediate access to the gun box and quick and easy opening of the latching mechanism once access is obtained. When the owner suddenly realizes that the gun is needed because an intruder has entered the home or office, the gun box must be immediately accessible—then easily opened. Thus, although the cardinal requirement in preventing children's accidents would be to keep the gun box out of sight and out of reach of the child, that requirement may thwart the owner's purpose in storing the gun: immediate accessibility. A gun kept unloaded in a closet would cost the owner precious time in a crisis situation.

There are several types of existing devices which have been used to carry and store dangerous firearms. Most existing gun boxes require a key to lock and unlock the box. Such boxes depend totally upon the availability of the key, however, which could become lost or misplaced. The key must be kept in another location, separate from the gun box lock. Consequently, the owner could lose access to the gun because an intruder blocks entry to the room having the key and could lose time searching for the key in darkness even if the room is not blocked. Moreover, the key could be used by a child who discovers its location. Every parent is aware of the ingenuity of children who, after observing a person use a key to open and close a box, could easily follow the example and gain access to the dangerous contents within.

The use of combination locks, another alternative, presents other problems. For example, the owner must recall the combination or have such unlocking information available. The owner could store the combination information in a safe place then fail to remember its location when needed. In addition, the owner must be adept in manipulating the combination lock. All of these factors could pose a serious hindrance in situations of haste or emergency when the gun is needed quickly.

The use of locks, therefore, has not proven entirely satisfactory. But any known type of unlocked gun box, no matter where located in the home or office, could be discovered and reached by a curious child or unauthorized adult with a normal amount of ingenuity. It is also unrealistic to expect the owner to remember to store the box properly at all times. Accordingly, a latching mechanism is needed which permits easy access by the parent or authorized adult yet makes access by a small child or unauthorized adult highly unlikely.

A firearm safety box is disclosed in U.S. Pat. No. 3,307,755, issued to Lentz, which provides a safety rod inserted into the barrel of the gun. The gun must be empty before it can be stored and the box itself can only accommodate and lock the firearm for which it is intended.

U.S. Pat. No. 4,768,021, issued to Ferraro, discloses a safe, mounted to another structure, for a loaded hand gun. The mounted safe is not portable. The release mechanism which opens the safe is activated by a numerical, alphabetical, or fingerprint identification electronic touch pad. Thus, a number or alphabet sequence must be remembered or, if a fingerprint is used, access is limited to a small number of people. Moreover, access requires time consuming entries on the pad and the entries cannot be done in the dark.

Other existing gun boxes avoid locks but require a maze-type or other complicated manipulation of a mechanism to open the box. Some of these devices could easily confuse a responsible owner attempting to open the box—particularly when in an agitated state of mind and in a great hurry. Moreover, children have been known to demonstrate how to open boxes of that type to an adult unable to do so.

The prior attempts to develop a gun box latching mechanism which allows easy access by authorized adults yet prevents unauthorized or accidental access have not been completely satisfactory. In part, the problem is that existing latching mechanisms have not been widely accepted—either because adults find them inconvenient or because children can open them. The need for a latching mechanism more effective than those presently available is apparent.

To overcome the shortcomings of existing gun box latching mechanisms, a new latching mechanism is provided. Although locks have been provided in the past, a key or combination lock may be included to provide a further degree of safety integrity against the unauthorized use by another. An object of the present invention is to provide a safety latching mechanism which is child resistant and which protects against unauthorized opening by adults.

A related object is to avoid exposing unnecessarily the fact that the box of the present invention encloses a weapon. Another object is to provide a box which is economical to manufacture, is portable, and has an attractive appearance. Still another object is to offer substantially instantaneous access, but only to the owner, to the contents of the box even in total darkness. The prevention of inadvertent opening when, for example, the box is dropped, by providing a sturdy and reliable latching mechanism, is another object.

An additional object of the present invention is to provide a box which will store safely one or more firearms, including a variety of firearms. A further object is to accommodate both loaded and unloaded guns.

SUMMARY OF THE INVENTION

To achieve these and other objects, and in view of its purposes, the present invention provides a portable gun box for safely storing at least one of a variety of loaded and unloaded firearms. The gun box includes a child-resistant latching mechanism positioned inside the gun box. In turn, the latching mechanism has a slidable first latching arm, a slidable second latching arm adapted to engage and disengage the first latching arm, a catch attached to the second latching arm to engage a hook on the lid of the gun box when the gun box is closed and to disengage that hook when the gun box is open, and a guide bracket attached to the gun box and substantially surrounding the catch to prevent the hook from disengaging the catch unless the first latching arm and the second latching arm are disengaged. The gun box also includes structure positioned outside the gun box, but penetrating to inside the gun box to engage the latching mechanism and allow the latching mechanism to be operated from outside the gun box, and resilient linings for pushing open the lid of the gun box when the latching mechanism is released.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing, in which.

DETAILED DESCRIPTION OF THE INVENTION

Figure 1:
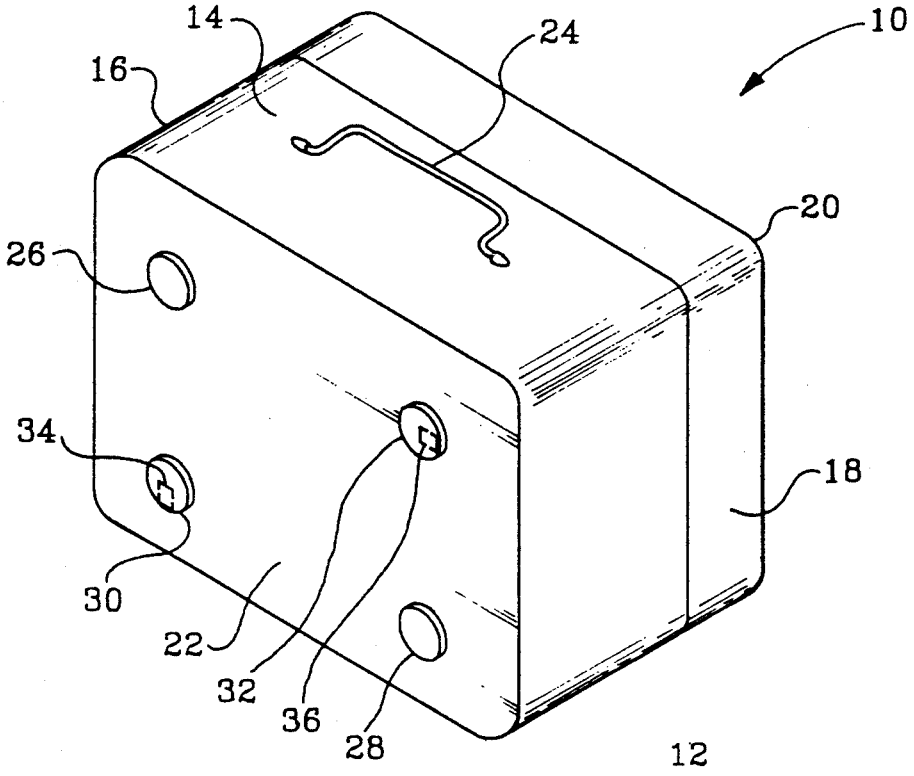
FIG. 1 is a perspective view of the gun box incorporating the latching mechanism of the present invention and illustrating the latching mechanism in a closed position.
Figure 2:
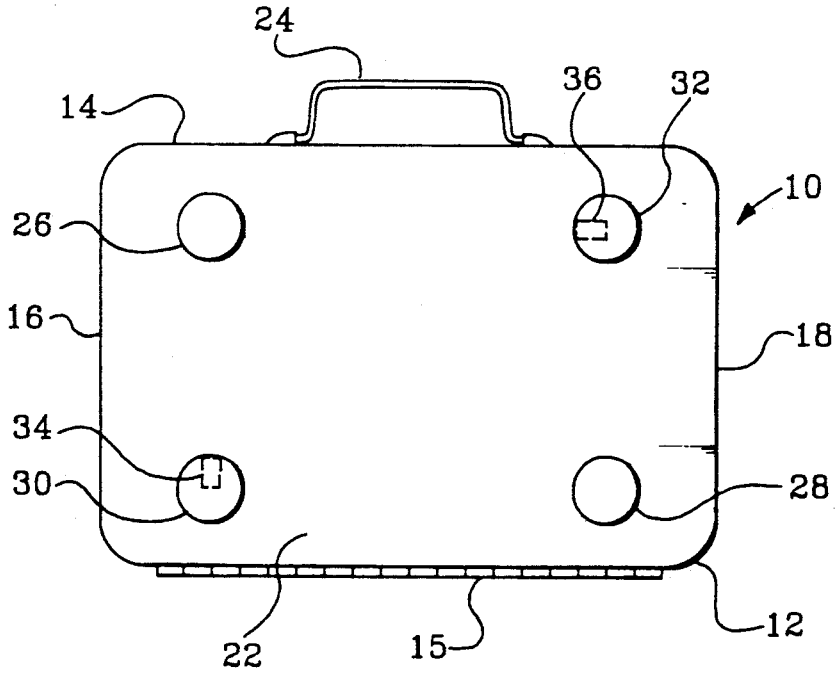
FIG. 2 is a bottom view of the gun box incorporating the latching mechanism of the present invention and illustrating the latching mechanism in an open position.

Referring now to the drawing, wherein like reference numerals refer to like elements throughout, FIGS. 1 and 2 illustrate a gun box 10 having a back 12, a front 14, a first side 16, a second side 18, a lid 20, and a bottom 22. Gun box 10 is free-standing, not affixed to any additional structure, and is rendered portable by a carrying handle 24 positioned on the outside of front 14. A hinge 15 joins back 12 and lid 20 to allow gun box 10 to be opened and closed. Preferably, gun box 10 is made of double-walled, fire-retardant, lightweight steel. Suitable dimensions for gun box 10 are 5×9×12.75 inches.

Gun box 10 has four feet on bottom 22 for support. First foot 26, second foot 28, third foot 30, and fourth foot 32 are substantially identical so that no external differentiation between them can be made. First foot 26 and second foot 28 are fixed on bottom 22 adjacent opposite corners of gun box 10. Third foot 30 and fourth foot 32 are also positioned adjacent opposite corners of gun box 10. Unlike first foot 26 and second foot 28, however, third foot 30 can slide relative to bottom 22 along a first channel 34 cut in bottom 22 and fourth foot 32 can slide relative to bottom 22 along a second channel 36 cut in bottom 22.

Figure 3:
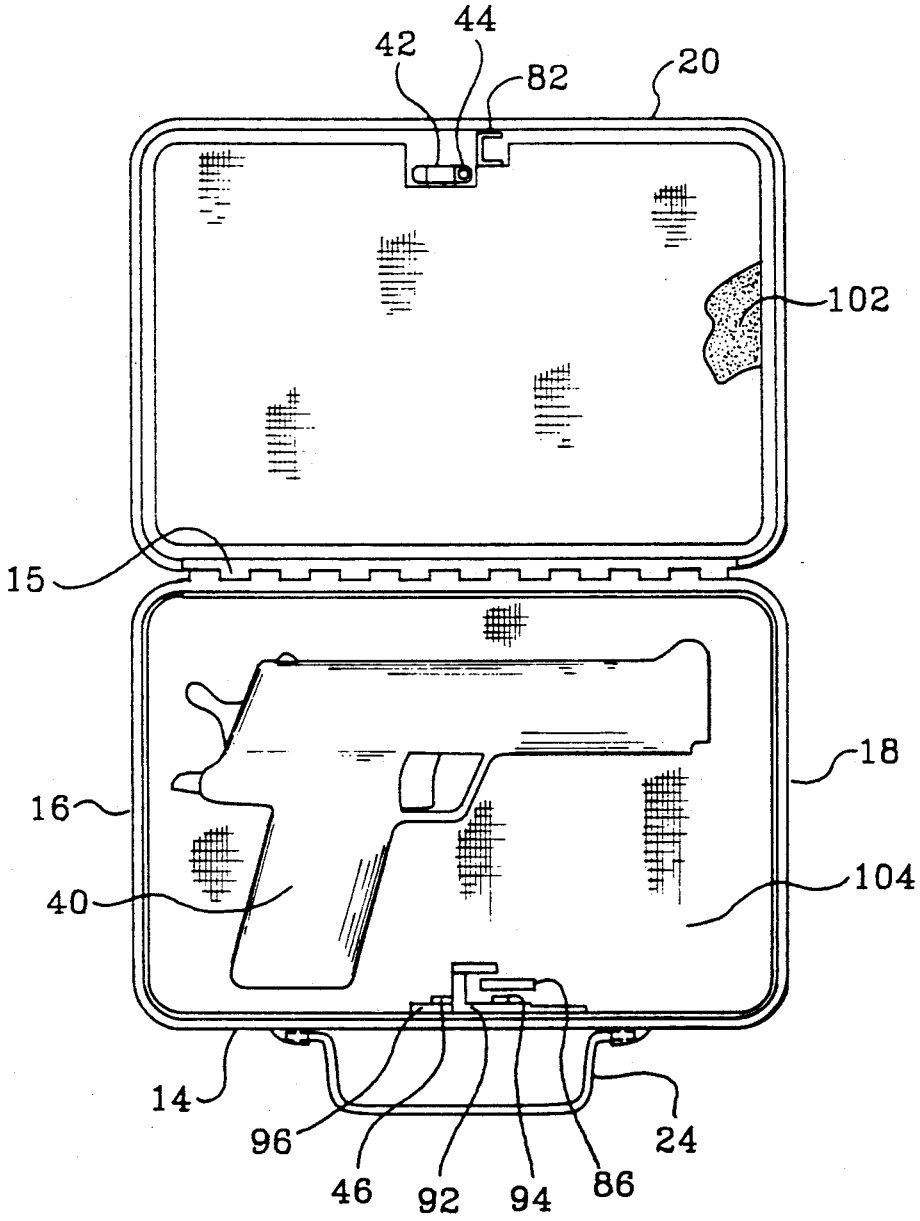
FIG. 3 is a plan view of the gun box incorporating the latching mechanism of the present invention showing a gun in position.

FIG. 3 shows a gun 40 in position within an open gun box 10. As shown in FIG. 1, an observer of closed gun box 10 would not be appraised of the fact that gun box 10 contains gun 40. FIG. 3 also illustrates several elements of the latching mechanism 50 of the present invention, described in detail below with reference to FIGS. 4, 5, and 6. Latching mechanism 50 is child resistant and offers protection against unauthorized opening by adults.

Gun box 10 may be provided with a conventional key or combination lock to provide a further degree of safety integrity against the unauthorized use by another. One example of such a lock, a key lock, is shown in FIG. 3. Tooth 42 of the key lock is affixed to lid 20 of gun box 10 and is rotated around pivot 44 by insertion of a key into the lock face (not shown) on top of lid 20. The lock is open as shown in FIG. 3. After gun box 10 is closed, it may be locked by rotating tooth 42 until it engages under rib 46 affixed to front 14 of gun box 10.

Figure 4:
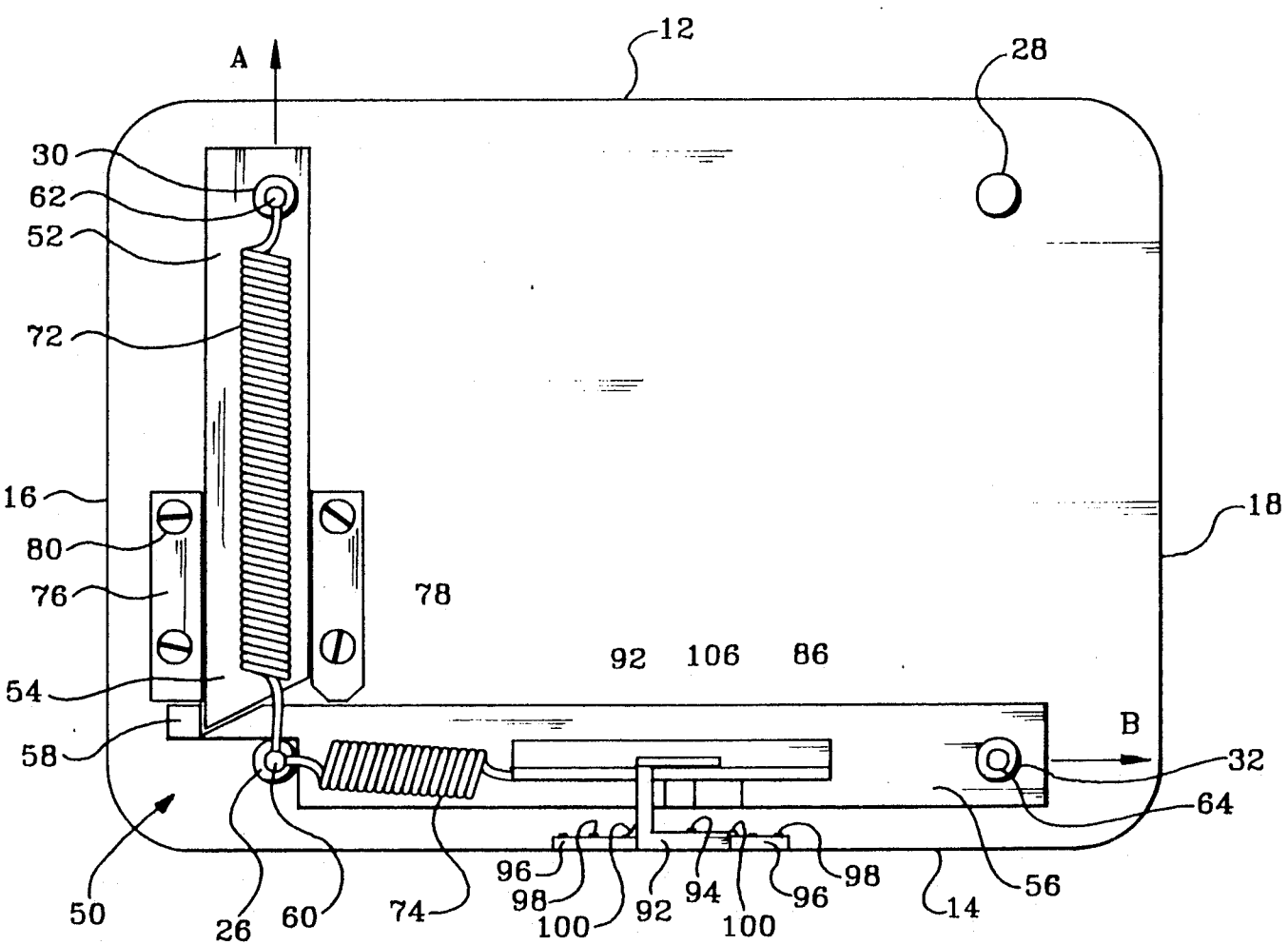
FIG. 4 is a top view of the latching mechanism of the present invention in the closed position.
Figure 5:
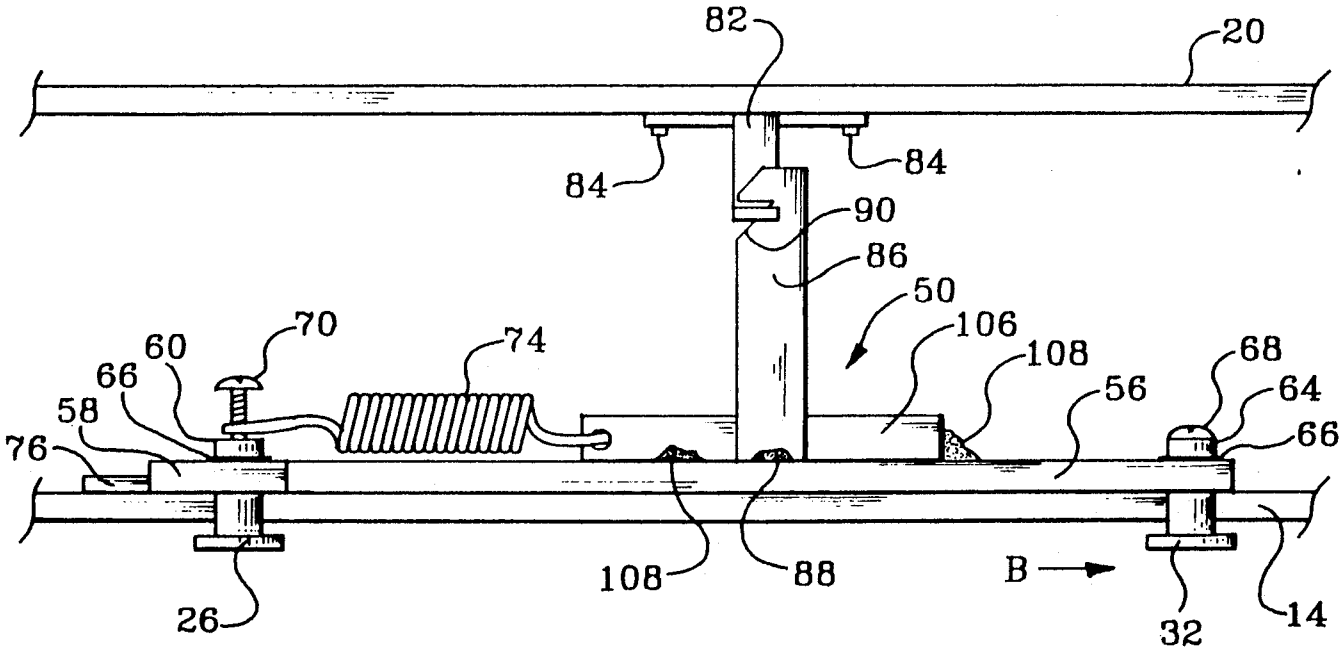
FIG. 5 is a front view of the latching mechanism of the present invention in the closed position, with the front of the gun box and the guide bracket cut away.
Figure 6:
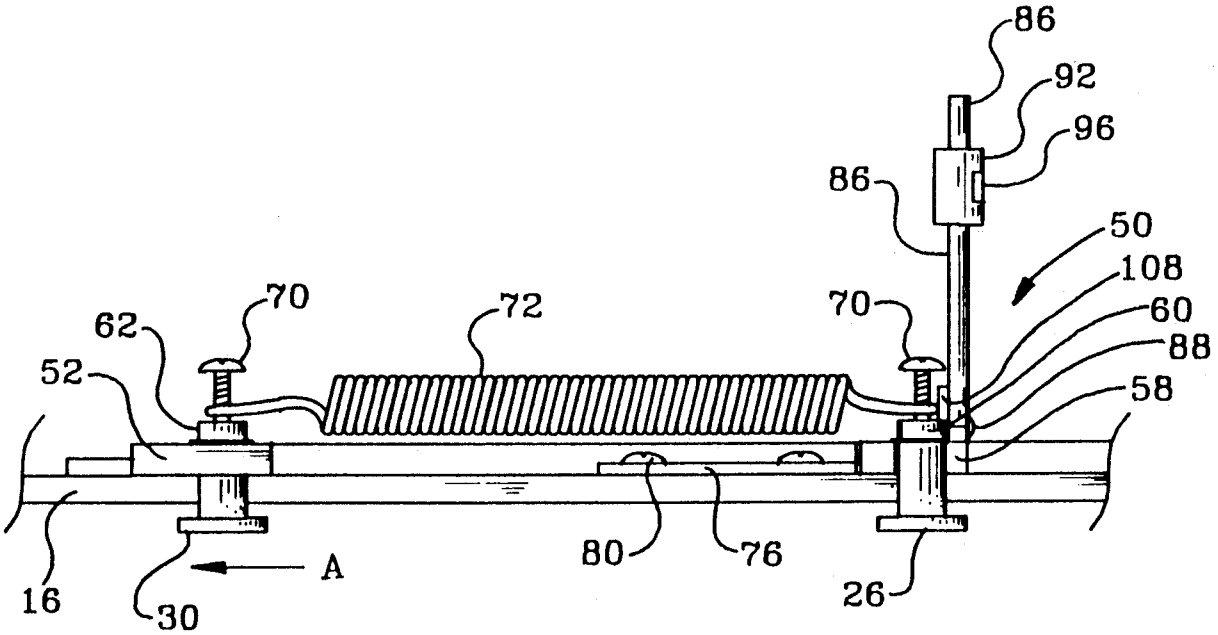
FIG. 6 is a side view of the latching mechanism of the present invention in the closed position, with the side of the gun box cut away.

Turning to FIGS. 4, 5, and 6, child-resistant latching mechanism 50 of the present invention is shown in place on the inside of bottom 22 of gun box 10. Latohinq meohanism 50 has a side latching arm 52. Side latching arm 52 is substantially rectangular in shape and extends along (parallel to) first side 16 of gun box 10. The end 54 of side latching arm 52 closest to front 14 of gun box 10 is substantially V-shaped.

Latching mechanism 50 also has a front latching arm 56. Like side latching arm 52, front latching arm 56 is substantially rectangular in shape. Front latching arm 56 extends along (parallel to) front 14 of gun box 10. The end of front latching arm 56 closest to first side 16 of gun box 10 has a substantially V-shaped notch 58. V-shaped notch 58 is designed to engage V-shaped end 54 of side latching arm 52 and to hold side latching arm 52 in locking engagement with front latching arm 56 when latching mechanism 50 is in a closed position.

First foot 26 has a portion 60 which projects into the inside of gun box 10 through bottom 22 of gun box 10. Third foot 30 has a portion 62 which projects into the inside of gun box 10 through first channel 34 and bottom 22 of gun box 10 and through a hole in side latching arm 52. Similarly, fourth foot 32 has a portion 64 which projects into the inside of gun box 10 through second channel 36 and bottom 22 of gun box 10 and through a hole in front latching arm 56. Washers 66, nuts, bolts 68, screws 70, and the like may be used to engage projecting portions 60, 62, and 64 and to hold side latching arm 52 and front latching arm 56 in position.

A first guide bar 76 and a second guide bar 78 are affixed to bottom 22 of gun box 10. Screws, bolts, or the like 80 are suitable to affix guide bars 76, 78. Guide bars 76, 78 extend along each side of side latching arm 52 to provide a track along which side latching arm 52 can slide.

The ends of guide bars 76, 78 abut front latching arm 56 and provide a guide for travel of front latching arm 56. The end of guide bar 78 abutting front latching arm 56 may be cut to reduce friction between guide bar 78 and front latching arm 56. The end of front latching arm 56 closest to first side 16 of gun box 10, which has substantially V-shaped notch 58, is cut to abut projecting portion 60 of first foot 26 when latching mechanism 50 is closed. As shown in FIG. 4, projecting portion 60 acts as a guide for front latching arm 56 as it slides.

A side spring 72 extends between projecting portion 62 on third foot 30 and projecting portion 60 on first foot 26. Side spring 72 urges side latching arm 52 into engagement with front latching arm 56. A front spring 74 extends between projecting portion 60 on first foot 26 and a support angle 106. Support angle 106 is affixed (e.g., by welds 108) to front latching arm 56 and to a vertical catch 86. Front spring 74 urges front latching arm 56 into engagement with side latching arm 52.

Gun box 10 has a U-shaped hook 82 attached to and projecting downward from lid 20. Rivets 84 are suitable for attaching hook 82 to lid 20. Vertical catch 86 is attached to front latching arm 56, preferably by a weld 88, near the center of front latching arm 56. Vertical catch 86 has a V-shaped slot 90 near its top. Slot 90 engages hook 82 when gun box 10 is closed.

A U-shaped guide bracket 92 is attached to front 14 of gun box 10 Screws, bolts, or the like 94 are suitable for attaching guide bracket 92. Guide bracket 92 substantially surrounds vertical catch 86, as shown in FIGS. 3 and 4. The dimensions of hook 82 and the spacing between guide bracket 92 and vertical catch 86 are chosen so that hook 82 is prevented from engaging and disengaging slot 90 of vertical catch 86 unless side latching arm 52 and front latching arm 56 are disengaged (latching mechanism 50 is open).

A reinforcing bar 96 also is attached, as by screws, bolts, or the like 98, to front 14 of gun box 10. Reinforcing bar 96 provides support for guide bracket 92 and may be attached, as by weld 100, to guide bracket 92. Once latching mechanism 50 is closed, a position in which hook 82 engages slot 90 of vertical catch 86, guide bracket 92 prevents inadvertent opening of latching mechanism 50 by preventing hook 82 from disengaging slot 90 of vertical catch 86 unless latching arms 52, 56 are purposefully moved.

Thus, gun box 10 is provided with an additional safety feature. Even if unlocked, latching mechanism 50 of gun box 10 will not open unless feet 30, 32 are moved (as discussed in detail below). This is true even if gun box 10 is dropped, either accidentally or purposefully.

Drop tests were conducted using an unlocked, latched prototype of the gun box 10 having latching mechanism 50. Gun box 10 has a total weight, without gun 40, of about 9.75 pounds. A 3-pound replica of a gun and an additional 2 pounds of weight were placed inside gun box 10. Gun box 10 was then dropped four times from a height of 7 feet onto a stone surface. No signs of opening were observed.

As shown in FIG. 3, a first resilient lining 102 is attached (e.g., glued) to the inside of lid 20 of gun box 10. A second resilient lining 104 is removably inserted into gun box 10, although lining 104 also may be glued to bottom 22. Linings 102, 104 may be foam, but any flexible material offering a "spring" action after compression is suitable. Moreover, linings 102, 104 are compressed when gun box 10 is closed. When latching mechanism 50 is later released, compressed linings 102, 104 push upward against lid 20 and "pop" gun box 10 open. Linings 102, 104 are provided with cut outs to avoid interfering with the elements of the lock and latching mechanism 50.

Gun 40 is placed on top of second resilient lining 104 with gun box 10 open. When gun box 10 is subsequently closed, by closing lid 20 and latching mechanism 50, gun 40 is safely and snugly secured in position between first resilient lining 102 and second resilient lining 104. Thus, gun box 10 will store safely a variety of firearms having different sizes, shapes, and weights. Depending upon the sizes, shapes, weights, gun box 10 can hold a number of firearms simultaneously. Gun box 10 will also accommodate both loaded and unloaded guns. The snugness of fit keeps gun 40 from moving once gun box 10 is closed.

The operation of latching mechanism 50 will now be described in detail. When feet 30, 32 are in their normal (unmoved) position, latching arms 52, 56 are engaged (V-shaped end 54 of side latching arm 52 is within V-shaped notch 58 of front latching arm 56). Vertical catch 86 on front latching arm 56 is then closest to guide bracket 92 Thus, if gun box 10 is open, then it cannot be closed unless third foot 30 is activated because hook 82 on lid 20 will not engage slot 90 of vertical catch 86. Similarly, if gun box 10 is closed, then it cannot be opened unless feet 30, 32 are activated because hook 82 on lid 20 will not disengage slot 90 of vertical catch 86 (guide bracket 92 blocks hook 82).

Thus, latching mechanism 50 prevents both opening and closing gun box 10 by an unauthorized person who is unaware of the operation of feet 30, 32. Latching mechanism 50 also prevents opening gun box 10 by a small child, even if the child is aware of the operation of feet 30, 32, because small children are unable to operate feet 30, 32 sequentially and with sufficient force to overcome spring bias.

If it is desired to close an open gun box 10, one hand is used first to push third foot 30 within first channel 34 in the direction of arrow "A" in FIGS. 4 and 6 (toward back 12 of gun box 10). That action, against the force of side spring 72, will slide side latching arm 52 in the direction of arrow "A" and disengage V-shaped end 54 of side latching arm 52 from within V-shaped notch 58 of front latching arm 56. Then, only then, and while maintaining third foot 30 against the force of side spring 72, a second hand is used to push downward on lid 20. That action will force hook 82 to slide down between guide bracket 92 and vertical catch 86. Hook 82 will push vertical catch 86 against the force of front spring 74 in the direction of arrow "B" in FIG. 5 and away from guide bracket 92, thereby allowing hook 82 to engage slot 90.

To open a closed gun box 10, one hand is used first to push third foot 30 within first channel 34 in the direction of arrow "A" in FIGS. 4 and 6 (toward back 12 of gun box 10). That action, against the force of side spring 72, will slide side latching arm 52 in the direction of arrow "A" and disengage V-shaped end 54 of side latching arm 52 from within V-shaped notch 58 of front latching arm 56. Then, only then, and while maintaining third foot 30 against the force of side spring 72, a second hand is used to push fourth foot 32 within second channel 36 in the direction of arrow "B" in FIG. 5 (toward second side 18 of gun box 10). That action, against the force of front spring 74, will slide front latching arm 56 in the direction of arrow "B". Consequently, vertical catch 86 will move along with front latching arm 56 away from guide bracket 92 and out of contact with hook 82. There is now sufficient room between vertical catch 86 and guide bracket 92 for hook 82 to slide up between guide bracket 92 and vertical catch 86 and to disengage slot 90 completely.

Linings 102, 104 are compressed when gun box 10 is closed. When hook 82 disengages slot 90, latching mechanism 50 is released and compressed linings 102, 104 push upward against lid 20 and "pop" gun box 10 open (hook 82 slides up between guide bracket 92 and vertical catch 86).

As will be appreciated by those of ordinary skill in the art, latching mechanism 50 offers substantially instantaneous access, but only to the owner who is aware of the precise operation of feet 30, 32, to the contents of the box even in total darkness. Experiments using a prototype of the present invention have shown that an owner can open gun box 10 in about 1.5 seconds strictly by "feel" and without looking at gun box 10. Moreover, the dexterity required by the use of two hands to slide feet 30, 32 simultaneously renders latching mechanism child resistant—even if a lock is not provided or is left open.

Moreover, gun box 10 does not externally expose the fact that gun box 10 encloses a gun 40. Visually, gun box 10 is merely an attractive carrying case. The elements necessary to open gun box 10 and the method of operating those elements cannot be determined by merely inspecting the periphery of a latched gun box 10. All four feet 26, 28, 30, 32 appear identical and fixed on bottom 22 of gun box 10.

Although illustrated and described herein with reference to certain embodiments, the present invention is nevertheless not intended to be limited to the details shown. Rather, various modifications may be made in the details within the scope and range of equivalents of the claims and without departing from the spirit of the invention.

What is claimed is:

1. An improved portable gun box for safely sorting at least one of a variety of loaded and unloaded firearms and of the type having a back, a front, first and second sides, a bottom, a plurality of feet outside said gun box on said bottom to support said gun box, a lid hingedly attached to said back for opening and closing said gun box, and a hook affixed to and projecting downward from said lid inside said gun box, wherein the improvement comprises a child-resistant latching mechanism positioned on the inside of said bottom of said gun boxy and including:

a first latching arm slidably engaging said bottom of said gun box, said first latching arm having a projecting end, a second latching arm slidably engaging said bottom of said gun box, said second latching arm having an end with a notch which engages said projecting end of said first latching arm when said latching mechanism is in a closed position, a first foot of said plurality of feet projecting into the inside of said gun box through said bottom of said gun box and engaging said first latching arm for transmitting a sliding motion of said first foot to said first latching arm;

a second foot of said plurality of feet projecting into the inside of said gun box through said bottom of said gun box and engaging said second latching arm for transmitting a sliding motion of said second foot to said second latching arm;

a vertical catch attached to said second latching arm and having a slot near its top, said slot engaging said hook projecting downward from said lid of said gun box when said gun box is closed; and a U-shaped guide bracket attached to said front of said gun box and substantially surrounding said vertical catch, said guide bracket preventing said hook from disengaging said slot in said vertical catch unless said first latching arm and said second latching arm are disengaged.

2. An improved portable gun box as claimed in claim 1 further comprising:

a first spring positioned inside said gun box and engaging said first foot projecting inside said gun box, said first spring urging said first latching arm into engagement with said second latching arm; and a second spring positioned inside said gun box and urging said second latching arm into engagement with said first latching arm.

3. An improved portable gun box as claimed in claim 1 further comprising a first resilient lining attached to the inside of said lid of said gun box and a second resilient lining insertable into said bottom of said gun box, said linings securing said firearm between them, being compressed when said gun box is closed, and pushing said lid of said gun box open when said latching mechanism is opened.

4. An improved portable gun box as claimed in claim 1 further comprising means for locking said lid.

5. An improved portable gun box as claimed in claim 4 wherein said locking means is a key lock.

6. An improved portable gun box as claimed in claim 4 wherein said locking means is a combination lock.

7. An improved portable gun box as claimed in claim 4 further comprising first and second guide bars affixed to said bottom of said box, one of said first and second guide bars extending along each side of said first latching arm to provide a track for said first latching arm.

8. An improved portable gun box as claimed in claim 4 wherein a third foot of said plurality of feet projects inside said gun box and guides sliding of said second latching arm.

9. A portable gun box for safely storing at least one of a variety of loaded and unloaded firearms, said gun box comprising:

a back;

a front;

first and second sides;

a lid;

a bottom having first and second channels cut adjacent opposite corners in said bottom;

a U-shaped hook projecting downward from said lid of said gun box;

a hinge joining said back and said lid to allow opening and closing of said gun box;

first and second feet fixed adjacent opposite corners of said gun box on the outside of said bottom of said gun box for supporting said gun box, said first foot having a portion projecting into the inside of said gun box;

a child-resistant latching mechanism positioned on the inside of said bottom of said gun box, said latching mechanism having;

(a) a side latching arm extending along said first side of said gun box and slidably engaging said bottom of said gun box, said side latching arm having a substantially V-shaped end closest said front of said gun box, (B) a front latching arm extending along said front of said gun box and slidably engaging said bottom of said gun box, said front latching arm having a substantially V-shaped notch in its end closest said first side of said gun box which engages said substantially V-shaped end of said side latching arm when said latching mechanism is in a closed position, (c) third and fourth feet positioned adjacent opposite corners of said gun box on the outside of said bottom of said gun box for supporting said gun box and sliding said side latching arm and said front latching arm, respectively, said third foot having a portion projecting into the inside of said gun box through said first channel in said bottom of said gun box and through an end of said side latching arm opposite said V-shaped end and said fourth foot having a portion projecting into the inside of said gun box through said second channel in said bottom of said gun box and through an end of said front latching arm opposite said notched end, (d) a side spring extending between said portion of said third foot projecting inside said gun box and said portion of said first foot projecting inside said gun box, said side spring urging said side latching arm into engagement with said front latching arm, (e) a vertical catch attached to said front latching arm near its center and having a V-shaped slot near its top, said slot engaging said U-shaped hook projecting downward from said lid of said gun box when said gun box is closed, (f) a support angle affixed to said front latching arm and to said vertical catch;

(g) a front spring extending between said portion of said first foot projecting inside said gun box and said support angle said front spring urging said front latching arm into engagement with said side latching arm, and (h) a U-shaped guide bracket attached to said front of said gun box and substantially surrounding said vertical catch, said guide bracket preventing said U-shaped hook from disengaging said slot in said vertical catch unless said side latching arm and said front latching arm are disengaged.

10. A gun box as claimed in claim 9 further comprising means for locking said lid.

11. A gun box as claimed in claim 10 wherein said locking means is a key lock.

12. A gun box as claimed in claim 10 wherein said locking means is a combination lock.

13. A gun box as claimed in claim 9 wherein said front latching arm and said side latching arm are substantially rectangular.

14. A gun box as claimed in claim 9 further comprising first and second guide bars affixed to said bottom of said box, one of said first and second guide bars extending along each side of said side latching arm to provide a track for said side latching arm.

15. A gun box as claimed in claim 9 wherein said first foot provides a track to guide sliding of said front latching arm.

16. A gun box as claimed in claim 9 further comprising a handle positioned on the outside of said front of said gun box for carrying said gun box.

17. A gun box as claimed in claim 9 wherein said gun box is double-walled and fire-retardant.

18. A gun box as claimed in claim 9 wherein said gun box has approximate dimensions of $5 \times 9 \times 12.75$ inches.

19. A gun box as claimed in claim 9 further comprising a first resilient lining attached to the inside of said lid of said gun box and a second resilient lining insertable into said bottom of said gun box, said linings securing said firearm between them, being compressed when said gun box is closed, and pushing said lid of said gun box open when said latching mechanism is opened.

* * * * *